US005311719A

United States Patent [19]

Jahn

[11] Patent Number: 5,311,719

[45] Date of Patent: May 17, 1994

[54] METAL PANELS FOR ACCESSIBLE CONCEALED CEILING SYSTEM

[75] Inventor: Martin D. Jahn, Chicago, Ill.

[73] Assignee: Chicago Metallic Corporation, Chicago, Ill.

[21] Appl. No.: 978,363

[22] Filed: Nov. 18, 1992

[51] Int. Cl.[5] ..... E04B 5/52

[52] U.S. Cl. ..... 52/506.09; 52/762

[58] Field of Search ..... 52/484, 762

[56] References Cited

U.S. PATENT DOCUMENTS 3,479,073 11/1969 Collins ..... 52/762
4,026,081 5/1977 Delaney et al. .
4,291,783 9/1981 Harris .
4,463,537 8/1984 Rodriquez et al. ..... 52/484 X
4,665,669 5/1987 Neuser ..... 52/484
4,736,564 4/1988 Gailey .
4,852,325 8/1989 Dunn et al. .

*Primary Examiner*—Philip C. Kannan
*Attorney, Agent, or Firm*—Hill, Steadman & Simpson

[57] ABSTRACT

A suspended ceiling system utilizing main runners with cross runners, said main runners and cross runners having an inverted-T configuration with a web with flanges extending from opposite sides thereof and a plurality of metal panels. Each of the metal panels is provided with a suspension arrangement adjacent a pair of opposite edges to enable hanging the panel from flanges of adjacent main runners to conceal the runners. The suspension arrangement is such that space is provided to enable disassembling a panel from the system without disturbing adjacent panels. The panel may be provided with a stop arrangement which would prevent unintentional disengagement of the suspension arrangement from a flange of the main runner.

18 Claims, 3 Drawing Sheets

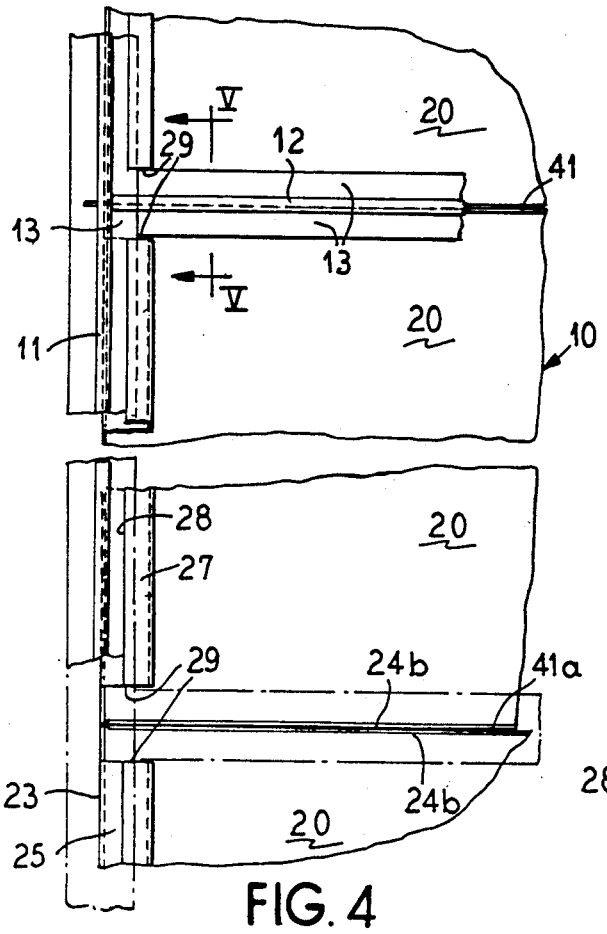
FIG. 4
FIG. 5
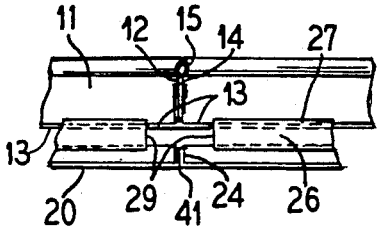
FIG. 6
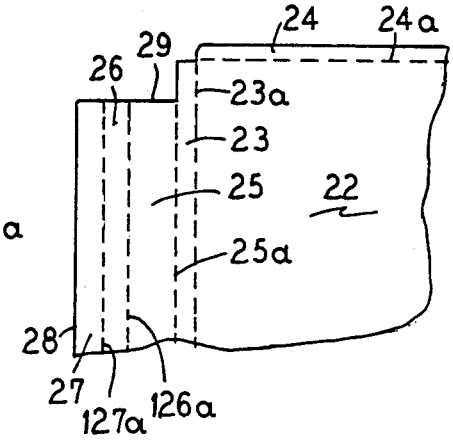
FIG. 7
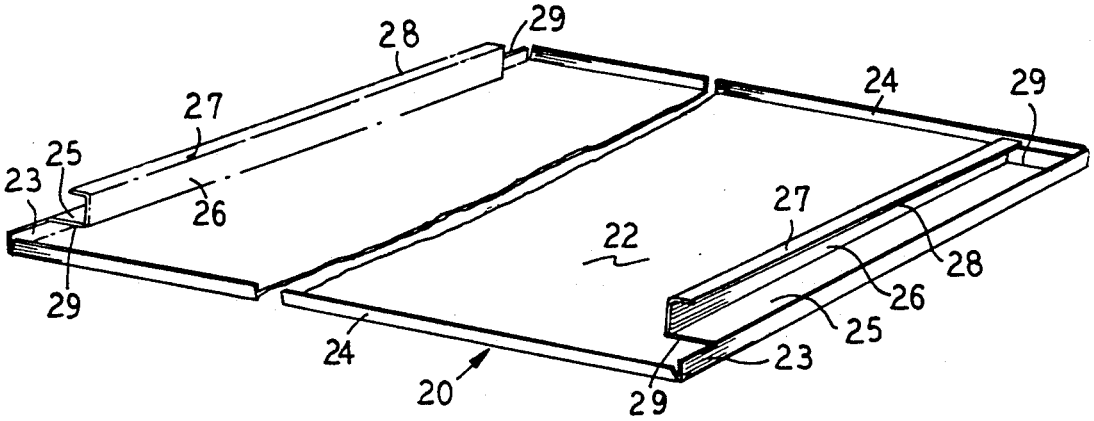

METAL PANELS FOR ACCESSIBLE CONCEALED CEILING SYSTEM

BACKGROUND OF THE INVENTION

The present invention is directed to a metal panel used in a suspended ceiling structure and to an accessible concealed ceiling system utilizing the panel.

It is known to provide a suspended ceiling system which utilizes a plurality of parallel-extending main runners and has a plurality of cross runners extending between the main runners to form openings which will receive a panel. Each of the runners has an inverted-T configuration, which, preferably, has a bead connected by a web portion to two outwardly-extending flanges. The flanges are used to support the panels. An example of such a system is disclosed in U.S. Pat. No. 4,852,325, whose disclosure is incorporated herein by reference thereto.

Instead of laying the panels on the flanges, it has also been proposed to have the panels shaped as a ship lap tile which has one edge provided with a rabbet or recess to enable it to lay on the flange of a runner while the other edge has a groove or kerf and is provided with a portion to extend under the flanges of the runner so that when assembled, the runners are not visible.

It has also been proposed to shape a metal panel to be suspended from the inverted-Ts in a manner similar to the ship lap tile. This arrangement is disclosed, for example, in U.S. Pat. No. 4,736,564.

In the first suspended ceiling system mentioned above, the panels are laying on the flanges and, thus, can be easily raised to gain access to any space above the suspended ceiling. With a ship lap tile, these can be raised at one side and then shifted to enable their removal to gain access to a space above the system. Also, some of the metal panels, such as disclosed in U.S. Pat. No. 4,736,564, can be removed. However, some of the structures disclosed in that patent are such that to remove a panel in the middle of a ceiling requires removal of all panels from one side back toward the center position. In order to gain access to the space above the ceiling, which space may include plumbing for a sprinkling system or air ducts for ventilation, it is desirable that any individual panel can be removed to enable access at a given spot.

SUMMARY OF THE INVENTION

The present invention is directed to a concealed, accessible ceiling system and a metal panel used in the system, which panel is suspended from the runners in a manner to hide the flanges of the runners and, yet, enables an easy removal of an individual panel anywhere in the ceiling system to gain access at that spot.

To accomplish these goals, the present invention is directed to a metal panel used in a ceiling system, which system has a plurality of parallel-extending main runners with spaced cross runners, each of the runners having an inverted-T structure with a web portion and outwardly-extending flanges, the metal panel having a rectangular, planar sheet member with a first pair of opposite edges having first rims with an outer surface, said panel having a dimension extending between the outer surfaces of the first rims substantially the same as an on-center distance between two adjacent main runners, each of the first rims having suspension means for hanging the rim beneath the flange of the main runner with adjacent panels coacting to hide or conceal the flanges of the main runner, said suspension means including a first portion extending inwardly toward a center of the panel from the first rim and substantially parallel to the sheet member of the panel, said first portion terminating in a second portion extending at right angles to the first portion away from the plane of the sheet member and terminating in a third portion extending at right angles to the second portion and parallel to said first portion and facing outward with an edge terminating inward of the rim with the distance between the first and third portions being greater than the dimensions or thickness of the rim so that when a panel is hanging from the flange with the third portion resting on the flange, a rim portion of an adjacent panel can be lifted and moved into the space between the first and third portions to enable removal of that adjacent panel. In addition, the distance between the second portion of each suspension means and the free edge of the third portion of the opposite suspension means is less than a width of a flange. Preferably, each of the panels has a second rim on a second pair of opposite surfaces that extend between the first pair of surfaces and, preferably, the suspension means terminates inwardly of the second pair of rims to enable receiving flanges of a cross runner.

In order to prevent an inadvertent lateral movement of the panels relative to the runners to cause a release of the panels, it may be desirable to provide stop or positioning means for preventing the unintentional movement of the panel on the runners. This positioning means may be formed by a stop provided in the suspension means or by a stop provided on the second rim. Each of these stops are adjacent the upper or third portion of the suspension means and, in order to enable the installer to overcome the stop means, the distance between a lower edge of the stop means and the first portion must be greater than the dimension of the thickness of the rim. The stop means may be either tabs, which are bent out of the third portion, or a third portion having a step configuration. Another example of the stop means is a projecting edge of the second rim for engaging the flanges of the main runners.

Other advantages and features of the invention will be readily apparent from the following description of the preferred embodiments, the drawings and claims.

BRIEF DESCRIPTION OF THE DRAWINGS

FIG. 4 is a partial top plan view with portions broken away of a suspended, concealed ceiling system in accordance with FIG. 1;

FIG. 5 is a cross sectional view taken along the lines V—V of FIG. 4;

FIG. 6 is a partial plan view of a blank illustrating the various fold lines for forming the panel in accordance with the present invention;

FIG. 7 is a top perspective view of a panel in accordance with the present invention;

DESCRIPTION OF THE PREFERRED EMBODIMENTS

Figure 1:
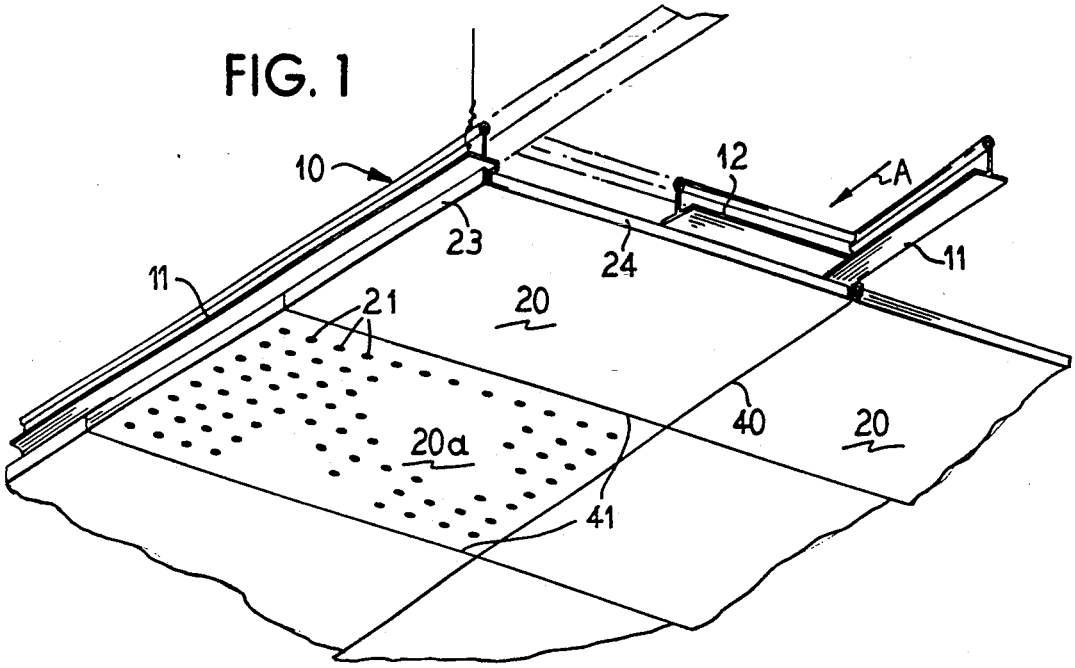
FIG. 1 is a perspective view with portions broken away for purposes of illustration of a suspended, concealed ceiling system utilizing the panels in accordance with the present invention.

The principles of the present invention are particularly useful when incorporated in a suspended, concealed ceiling system, generally indicated at 10 in FIG. 1 and which system has accessible panels. The suspended ceiling system 10 includes a plurality of parallel-extending main runners 11 which are spaced apart by cross runners 12 to form a grid system. A plurality of panels 20 and 20*a* are suspended on the grid system and, as illustrated, the grid system is not visible from the room, due to the covering of the runners 11 and 12.

Figure 2:
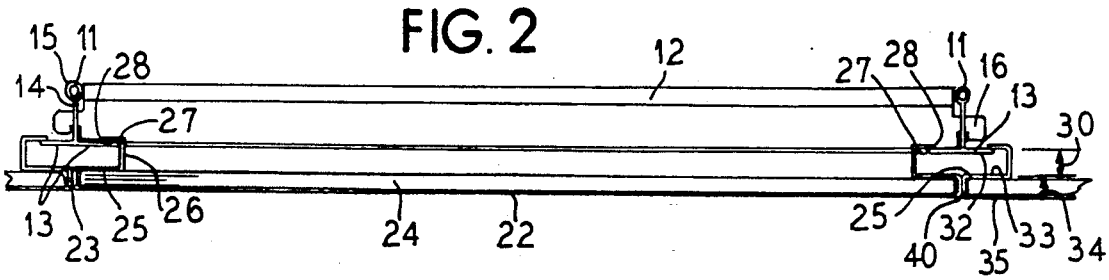
FIG. 2 is an end view taken in the direction of arrow A in FIG. 1 illustrating a panel supported on a pair of runners in accordance with the present invention.
Figure 3:
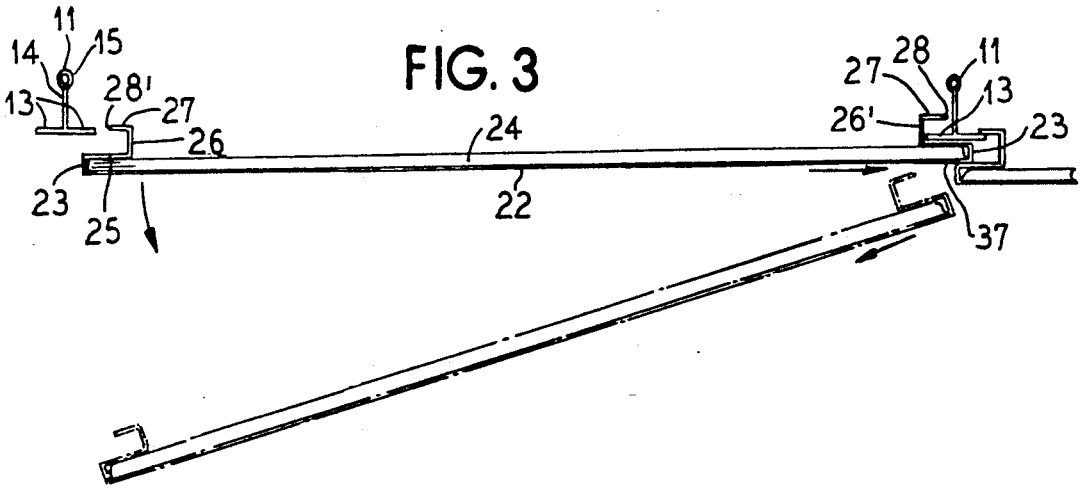
FIG. 3 is a view similar to FIG. 2 illustrating the movement of the panel during the removal of a panel from the ceiling system.

Each of the runners, as best illustrated in FIGS. 2, 3 and 5, has an inverted-T-shaped configuration which has a pair of flanges 13 extending from a bottom of a web portion 14 which terminates in an upper bead portion 15. The runners can have any shape or configuration with the bead assuming various structures, such as disclosed in the above-mentioned U.S. Pat. No. 4 852,325. The cross runners 12 are each provided with a connecting tab 16 to extend through openings or slots in the web of the main runners.

Each of the panels 20 and 20*a* are formed of a single sheet of material. The difference between the panels 20 and 20*a* is that the panel 20*a* has a plurality of perforations 21 and the panels 20 are free of perforations. The perforations 21 of the panel 20*a* are shown in rows and columns, but could be in a random pattern.

Each of the panels 20, 20*a* has a planar main portion or sheet portion 22 which, as best illustrated in FIG. 7, has a rectangular configuration with a pair of first rims 23 which are bent out of the plane of the main portion 22 on a pair of opposite edges. A second pair of rims 24 are on the other pair of opposite edges.

To suspend each of the panels in the grid system formed by the main runners 11 and the cross runners 12, each of the first rims 23 is provided with suspension means, which is formed by an integral hook portion extending from the rim 23. The hook portion includes a first portion 25 which extends parallel to the plane of the main portion or sheet portion 22 toward the center and terminates in a second portion 26 that extends at right angles to the first portion 25. The second portion 26 terminates at a third portion 27 that extends at right angles to the second portion 26 and parallel to the first portion 25 away from the center with a free edge 28 being spaced inward from the rim 23, as best illustrated in FIGS. 2 and 3. The opposite free edges 28 are spaced inward from the rims 23 and, as illustrated in FIG. 3, an edge 28' of one suspension means on the rim is at a distance from the second portion 26' on the opposite rim, which distance is less than the distance between the edges of two adjacent flanges 13 of two main runners 11. This will enable a shifting of the panel to allow the panel to be inserted into the opening formed between the flanges 13 and allows a shifting of the panel so that the third portions 27 will hang or be suspended on the flanges 13.

As illustrated in FIGS. 2 and 3, the second portion 26 has a dimension or width so that a distance 30 between a bottom surface 32 of the flange 13 and the upper surface 33 of the first portion 25 is greater than a distance 34 between the upper surface 33 and the lower surface 35 of the sheet portion 22 so that a rim portion 37, which is formed by a first rim 23 and adjacent portions of the main portion 22 and first portion 25, of an adjacent panel can be received between the bottom surface 32 of the flange and the upper surface 33 of the first portion 26, as illustrated in FIG. 3. This enables the insertion, as illustrated in FIG. 3, of one of the rim portions 37 into suspension means of the adjacent rim so as to disengage the opposite suspension means from the other main runner 11 and allow the panel 20 to be rotated downward and then removed. Insertion of the panel is in the opposite direction.

It should be pointed out that the edges or outer surfaces of the first rims 23 have a distance which is substantially equal to the on-center distance or distance between the webs 14 of adjacent runners 11. Thus, as illustrated in FIG. 2, two adjacent panels have an outer surface of each of the first rims 23 engaging each other to form a seam 40, which is in line with the web 14 of each of the runners 11.

As illustrated in FIG. 7, the portions 25, 26 and 27 forming the suspension means do not extend the full length of the rim 23 and terminate at an edge 29, which is spaced inward from the second rims 24. The distance between the edge 29 and the rim 24 is preferably selected to provide a space for receiving the flanges 13 of the cross runners, such as 12, as best illustrated in FIGS. 4 and 5.

As illustrated in FIG. 5, the second rims 24 of adjacent panels will be abutted against each other to form a seam 41 similar to the seam 40 formed by adjacent first rims. The seams 40 and 41 extend at right angles to each other (see FIG. 1).

The panels are formed out of sheet metal by a plurality of bends. For example, as illustrated in FIG. 6, the second rims are formed by bending along a line 24*a*. The first rims are formed by bending on a line 23*a*, with the first portion 25 separated from the first rim by a bend line 25*a* and separated from the second portion by a bend line 126*a*. The third portion is separated from the second portion by a bend line 127*a*. As illustrated in FIG. 6, a portion of the sheet is cut out adjacent the corner to provide the spacing from the edge 29 from the bend line 24*a*.

In utilizing the system, the panels can have a size up to 20 by 60 inches. The main runners can be spaced five feet apart or can be spaced four feet apart. If the panels have a length of 60 inches, then the main runners will be on five-foot centers. If the main runners are on four-foot centers, then, obviously, the panels will have a length of approximately 48 inches. The cross runners 12 can be spaced at any desired distance, such as four or six-foot on center. As illustrated in FIG. 4, the panels have less width than the spacing between the cross runners so that the rims 24b, 24b will form a seam 41a which is not directly under a cross runner 12.

As illustrated in FIGS. 2, 3 and 7, the portions 27 have a lesser width than the portions 25 so as to allow the disassembly and assembly of a panel into the ceiling system. The advantage of the system is that the panels can be easily removed individually after having been assembled without requiring the disassembly or movement of adjacent panels. This would not happen with the arrangement, such as disclosed in U.S. Pat. No. 4,736,564, which would require at least moving an adjacent panel while removing a panel.

Figure 8:
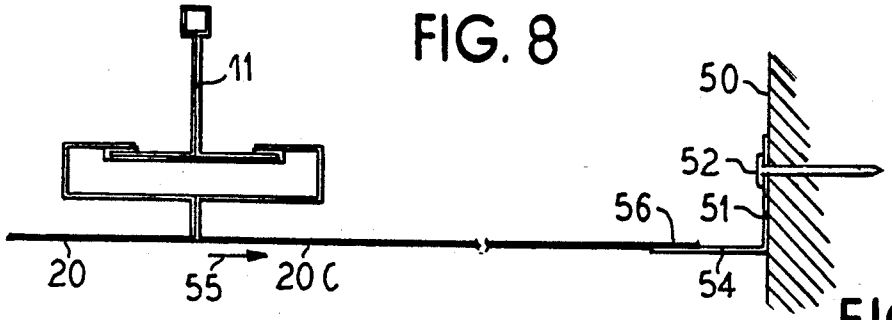
FIG. 8 is an end view similar to FIG. 2 illustrating the connection of a panel to a side wall.

The panels 20 and 20a illustrated in FIGS. 1-7 can, possibly, slip or move laterally together so as to disengage one of the suspension means from the flanges 13. In some instances, this can be prevented by securing or anchoring a panel adjacent a side wall of the room, as illustrated in FIG. 8. In FIG. 8, a side wall 50 is provided with a bracket, such as an edge member 51 which has a cross section with a right angle bend and is secured by nails, such as 52, to the side wall. A panel 20c that extends between the closest main runner 11 is supported at one end by the suspension means on the flange of the main runner 11 and has the opposite end resting on a leg 54 of the edge member 51. If the panel 20c is not secured to the edge member 51, it can shift in a direction of arrow 55 to allow the suspension means to inadvertently disengage from the flange of the main runner 11. One way of preventing this would be to secure the edge 56 of the panel 20c to the leg 54 of the edge member 51. With the panel 20c being secured to the edge member 51, it will not be able to shift in the direction of arrow 55 or in a direction opposite to the arrow 55. The panel 20c will, thus, help position the remaining panels 20. However, when there are great distances between the side walls, this may not be sufficient, due to tolerances in the size of the panel and also it may not be desirable to secure the edge panels 20c to the edge members 51.

Figure 9:
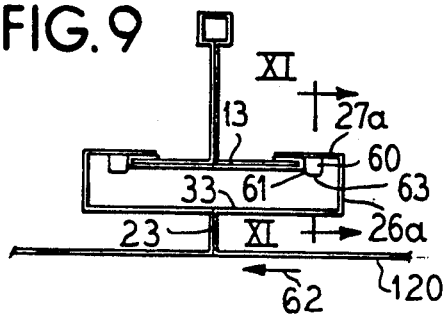
FIG. 9 is a partial cross sectional view similar to FIG. 2 showing one embodiment of a stop means for limiting movement and positioning the suspension means on the flanges of the main runners.
Figure 10:
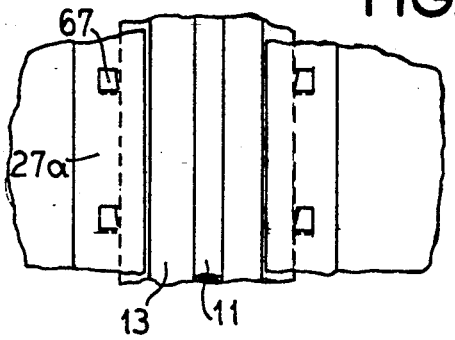
FIG. 10 is a partial plan view of the stop means of FIG. 9.
Figure 11:
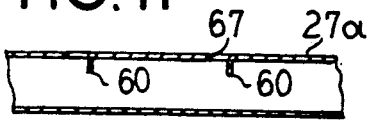
FIG. 11 is a cross sectional view taken along the lines XI—XI of FIG. 9.
Figure 12:
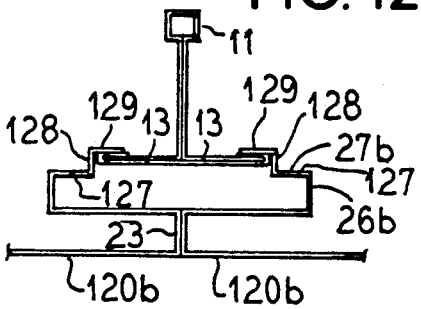
FIG. 12 is a end view similar to FIG. 9 of another embodiment of a stop means for positioning the panels on the flanges of the main runner.

Thus, in order to prevent the inadvertent disengagement of the suspension means from the flange of one of the runners the panel is provided with positioning or stop means which will aid in positioning the third portion of each of the suspension means on the respective flanges. One embodiment of the stop means is illustrated in FIG. 9 by a panel 120 which has a third portion 27a of the suspension means provided with a tab 60 which has been cut and bent out of the plane of the third portion. The tab 60 will have an edge 61, which may extend perpendicular to the plane of the portion 27a or at a slight angle off of the perpendicular to provide a camming edge. The edge 61 engages an edge of the flange 13 to limit movement of the panel 120 in a direction, such as arrow 62. The tabs can be a single tab provided at each end of the flange 27a or a series of tabs spaced along the length of the portion 27a. It should be noted that the tab 60, when punched out of the portion 27, leaves an opening or aperture 67 (FIGS. 10 and 11). However, this will not be visible to the occupants of the room, since it is covered by the remaining portions of the panels 120. In order to disassemble the panel 120 from the flange 13 of the runner 11, it will be necessary to, first, lift the panel a distance to clear a bottom edge 63 of the tab 60 over the flange before the panel can be shifted in a direction 62 to insert the rim 23 in the space between the flange 13 and the upper surface 33. It may be desirable that the second portion, such as 26a, has a greater height than in the earlier embodiments.

Instead of forming the stop means from a tab, such as 60 as shown in the embodiment of FIGS. 9, 10 and 11, a panel 120b has a third portion 27b which has a stepped configuration. As illustrated, the portion 27b is subdivided into sub-portions 127, 128 and 129 with the sub-portion 128 extending at right angles to the portions 127, 129 to form a step that acts as a stop similar to the tab 60.

Figure 13:
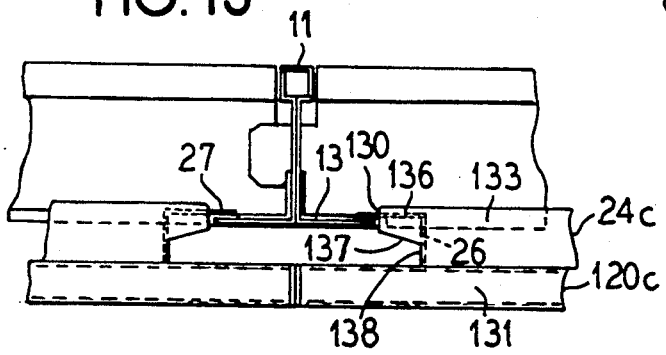
FIG. 13 is an end view of a panel with a third embodiment of the stop means.
Figure 14:
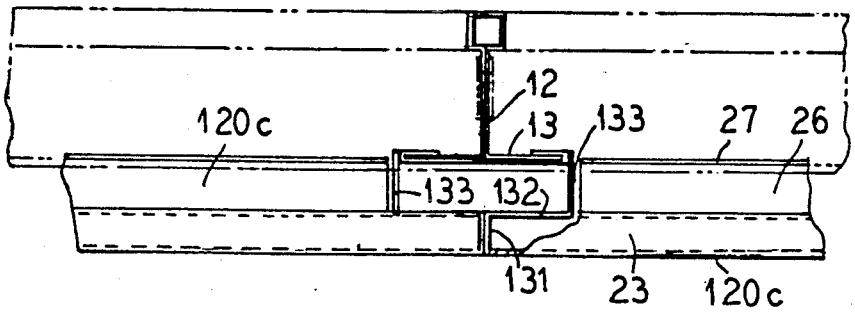
FIG. 14 is an end view taken along the lines XIV—XIV of FIG. 13, with portions broken away for purposes of illustration.

In the embodiments of the panels 120 and 120b, the stop means is formed as part of the suspension means and is formed in the third portion. In another embodiment, which is illustrated in FIGS. 13 and 14, a panel 120c has the stop means formed by an end edge 130 of a second rim 24c. As best illustrated in FIG. 14, the second rim 24c is formed of three sections 131, 132 and 133 to provide a step cross sectional configuration. The first section 131 extends at substantially right angles to the plane of the panel 120c. The second section 132 extends at right angles to the section 131 and parallel to the plane of the panel 120c. The third section 133 extends at right angles away from the plane of the panel and parallel to the section 131. As illustrated in FIG. 14, the section 130 has a length sufficient to allow the insertion of the flanges 13 of the cross member or tee 12 between the spaced apart sections 133. The edge 130 is on an extension or projection 136 of the third section 133. This extension 136 is along an upper edge and has a tapering cut-out edge 137 which provides a gap or hole for receiving the edge of the flange 13 of the main runner when removing the panel 120c. The edge 137 runs back to an edge 138, which is positioned at least in alignment with the second portion 26 of the suspension means. As in the previous embodiments, a lifting of the panel 120c will allow the edge of the flange 13 to ride along the edge 137 as the panel is shifted to a position to disengage one of the pairs of suspension means to allow removal of the panel.

Although various minor modifications may be suggested by those versed in the art, it should be understood that I wish to embody within the scope of the patent granted hereon all such modifications as reasonably and properly come within the scope of my contribution to the art.

I claim:

1. A metal panel for use in a ceiling system having a plurality of main runners provided with flanges, said panel comprising a rectangular planar sheet member having first rims on two opposite edges, said first rims being provided with integral suspension means for suspending the panel on the flanges of adjacent main runners, said suspension means of each rim being formed by an integral first portion inwardly extending at right angles to the rim and parallel to a plane of the sheet member, said first portion terminating in a second portion extending at right angles to the first portion away from the sheet member, said second portion terminating in a third portion extending at right angles to the second portion and parallel to the first portion and facing outward with an edge terminating inward of the rim, said second portion having a width greater than the height of the rim to enable insertion of an adjacent rim in a space between the first portion and a flange supporting the third portion.

2. A metal panel according to claim 1, which further includes second rims being applied on the other opposite edges of the rectangular planar sheet member.

3. A metal panel according to claim 2, which includes stop means for engaging an edge of a flange of the main runner to prevent an unintentional disengaging of the suspension means from a flange of a main runner.

4. A metal panel according to claim 3, wherein the stop means is formed on the third portion.

5. A metal panel according to claim 4, wherein the stop means is a tab bent out of the plane of the third portion.

6. A metal panel according to claim 1, wherein the suspension means extends substantially along the length of each of the first rims and terminates in opposite edges spaced inward from the end of each of the first rims by a distance equal to at least one-half of the width of the flange of a cross runner and the panel has stop means for engaging an edge of the flange of the main runners to prevent unintentional disengagement of the suspension means from the flange.

7. A metal panel according to claim 6, which has a continuous configuration free of any perforations.

8. A metal panel according to claim 7, wherein the other opposite edges of the panel are provided with upstanding second rims.

9. A metal panel according to claim 6, wherein the rectangular planar sheet of the panel is provided with a plurality of perforations.

10. A metal panel according to claim 9, wherein the other opposite edges are provided with second rims.

11. A metal panel for use in a ceiling system having a plurality of main runners provided with flanges, said panel comprising a rectangular planar sheet member having first rims on two opposite edges, said first rims being provided with suspension means for suspending the panel on the flanges of adjacent main runners, said suspension means being formed by a first portion extending at right angles to the rim parallel to a plane of the sheet member and terminating in a second portion extending at right angles to the first portion away from the sheet member, said second portion terminating in a third portion extending at right angles to the second portion and parallel to the first portion and facing outward with an edge terminating inward of the rim, said suspension means including stop means for preventing an unintentional disengaging of the suspension means from a flange of a main runner, said stop means being a step formed in the third portion, and said second portion having a width greater than the height of the rim to enable insertion of an adjacent rim in a space between the first portion and a flange supporting the third portion.

12. A metal panel according to claim 11, which further includes second rims being applied on the other opposite edges of the rectangular planar sheet member.

13. A metal panel for use in a ceiling system having a plurality of main runners provided with flanges, said panel comprising a rectangular planar sheet member having first rims on two opposite edges and second rims on the other opposite edges of the rectangular planar sheet member, said first rims being provided with suspension means for suspending the panel on the flanges of adjacent main runners, said suspension means being formed by a first portion extending at right angles to the rim parallel to a plane of the sheet member and terminating in a second portion extending at right angles to the first portion away from the sheet member, said second portion terminating in a third portion extending at right angles to the second portion and parallel to the first portion and facing outward with an edge terminating inward of the rim, said second portion having a width greater than the height of the rim to enable insertion of an adjacent rim in a space between the first portion and a flange supporting the third portion, and said second rims having stop means for preventing an unintentional disengaging of the suspension means from the flange of the main runner.

14. A metal panel according to claim 13, wherein the second rim has a stepped cross section with a first section having a height equal to the height of the first rim, a second section extending laterally inward and terminating in a third section extending parallel to the first section, said second section having a width corresponding to a flange width of a cross runner to provide clearance therefor, said stop means being an edge of a projection adjacent an upper edge of the third section.

15. A ceiling system comprising a plurality of parallel-extending main runners with spaced cross runners, said main runners and cross runners each having an inverted-T cross sectional configuration with a web with flanges extending outwardly from both sides thereof, and a plurality of metal panels having a planar sheet portion with a rectangular shape with a first pair of opposite edges having first rims with an outer surface, said panels having a dimension between the outer surfaces of the first rims substantially the same as an on-center distance between two adjacent main runners to conceal the runners, each of said first rims having integral suspension means for hanging the rim beneath the flange of the main runners to conceal the runners, each of said suspension means including a first portion extending inwardly from the rim parallel to a plane of the sheet portion and terminating in a second portion extending at right angles away from said sheet portion and terminating in a third portion extending parallel to the first portion outwardly away from the center of the panel and terminating in an edge spaced inward from said rim, each of said suspension means including stop means for engaging an edge of the flange of the main runner to prevent an unintentional disengagement between the suspension means and the flange of the main runner, and the second portion has a width greater than the width of each of the first rims so that with the third portion resting on a flange, the distance from a lower surface of the flange and a surface of the first portion is larger than the height of the rim to enable a rim portion of an adjacent panel to be inserted into the space to enable removal of an individual panel without disturbing adjacent panels.

16. A ceiling system according to claim 15, wherein each of the other pairs of opposite edges has a second rim, and said panels are assembled on the main runners to form a plurality of seams, with the seams formed by the adjacent first rims lying substantially under the webs of the main runners and the seams formed by the second panels extending at approximately right angles to the first-mentioned seams.

17. A ceiling system according to claim 16, wherein each of the sheet portions has perforations.

18. A ceiling system according to claim 16, wherein the sheet portion is free of perforations.

* * * * *